US006527565B1

(12) United States Patent
Johns

(10) Patent No.: US 6,527,565 B1
(45) Date of Patent: Mar. 4, 2003

(54) ADJUSTABLE LIGHT DISPLAY ASSEMBLY

(76) Inventor: Robert L. Johns, P.O. Box 630041, Miami, FL (US) 33163

( * ) Notice: Subject to any disclaimer, the term of this patent is extended or adjusted under 35 U.S.C. 154(b) by 146 days.

(21) Appl. No.: 09/635,861

(22) Filed: Aug. 11, 2000

(51) Int. Cl.[7] ..... H01R 25/00
(52) U.S. Cl. ..... 439/116; 362/418; 439/112
(58) Field of Search ..... 362/418; 312/223.1, 312/223.6; 439/110, 116, 117, 120, 121

(56) References Cited

U.S. PATENT DOCUMENTS

| | | | | |
|---|---|---|---|---|
| 3,012,217 A | | 12/1961 | Pantin | |
| 3,308,416 A | | 3/1967 | Boyd | |
| 4,133,589 A | | 1/1979 | Johns | |
| 4,323,163 A | | 4/1982 | Johns | |
| 4,420,087 A | | 12/1983 | Johns | |
| 4,690,474 A | | 9/1987 | Smart et al. | |
| 4,747,025 A | * | 5/1988 | Barton | 211/94.01 |
| 4,967,327 A | | 10/1990 | Thurlow | |
| 5,034,861 A | * | 7/1991 | Sklenal et al. | 312/236 |
| 5,052,937 A | | 10/1991 | Glen | |
| 5,517,391 A | | 5/1996 | Grau | |
| 5,695,261 A | * | 12/1997 | Slesinger et al. | 312/223.6 |
| 6,298,623 B1 | * | 10/2001 | Wendt | 248/343 |

FOREIGN PATENT DOCUMENTS

| | | | | |
|---|---|---|---|---|
| GB | 2 120 024 A | * | 11/1983 | 439/116 |
| IT | 0 215 753 A2 | * | 3/1987 | 439/112 |

* cited by examiner

*Primary Examiner*—Sandra O'Shea
*Assistant Examiner*—James W Cranson
(74) *Attorney, Agent, or Firm*—Shlesinger, Arkwright & Garvey LLP

(57) ABSTRACT

This invention relates to an adjustable light display assembly in which the light is adjustable in a manner of a track light with the support for the light capable of assuming many configurations including wall panels, support stands and multiple light fixtures.

30 Claims, 4 Drawing Sheets

56
58
IB
IB 72
64
62
68
56
60
D
66
28
54
52
42
50
48
32
30
34
36
40
38
4
10
26
24
26
6
78
ON
OFF
8
S
2
56
58
58

ADJUSTABLE LIGHT DISPLAY ASSEMBLY

FIELD OF THE INVENTION

This invention relates to an adjustable light display assembly of the track light variety which can assume various configurations including wall and ceiling panels, support stands, including racks and advertising and display devices and the like.

BACKGROUND OF THE INVENTION

Article display units are known in which interlocking elongated members are assembled to form slotted panels, the slots of which receive mounting devices such as clips or hooks for directly or indirectly supporting articles. These display units may be wall mounted or free standing. Such display units are the subject of my previous U.S. Pat. Nos. 4,323,163 and 4,420,087. FIG. 24 of the '087 patent discloses a light tube located inside the display unit to provide a "dramatic effect".

Track-lighting systems for general purpose illumination have been known for sometime. They are used in homes, factories, art galleries and industrial areas generally.

Electrical outlet devices are well known such as Glen, U.S. Pat. No. 5,052,937, Thurlow, U.S. Pat. No. 4,967,327, Smart, U.S. Pat. No. 4,690,474, Pantin, U.S. Pat. No. 3,012,217, Boyd, U.S. Pat. No. 3,308,416 and Grau, U.S. Pat. No. 5,517,391.

OBJECTS AND SUMMARY OF THE INVENTION

It is an object of this invention to provide an adjustable light display assembly of a track light type adaptable to various structures such as walls and ceiling panels, racks, poles or standards and advertising structures and the like.

Another object of this invention is to provide an adjustable light display assembly which is adaptable to standard manufacturing equipment and readily assembled.

A further object of this invention is to provide an adjustable light display assembly which is inexpensive to manufacture.

A further object of this invention is to provide an adjustable light display assembly which may be readily moved from one area to another and which is adaptable to both wall panels and free standing stands and racks.

Still a further object of this invention is to provide an adjustable light display assembly which can be used in advertising.

Yet another object of this invention is to provide an adjustable light display assembly which has the capability of being used at department stores to support articles of clothing and the like.

A further object of this invention is to provide an adjustable light display assembly which permits quick adjustments either laterally or vertically of the light mechanism.

Another object of this invention is to provide an adjustable light display assembly which has strength to support heavy loads including shelving, garment hangers and the like.

In summary, the present invention relates to an adjustable light display assembly capable of being used for multipurposes in homes, factories and stores and the like which will become apparent from the following detailed description including the following drawings in which;

BRIEF DESCRIPTIONS OF THE DRAWINGS

DETAILED DESCRIPTION OF THE INVENTION

Figures 1, 1A, 1B:
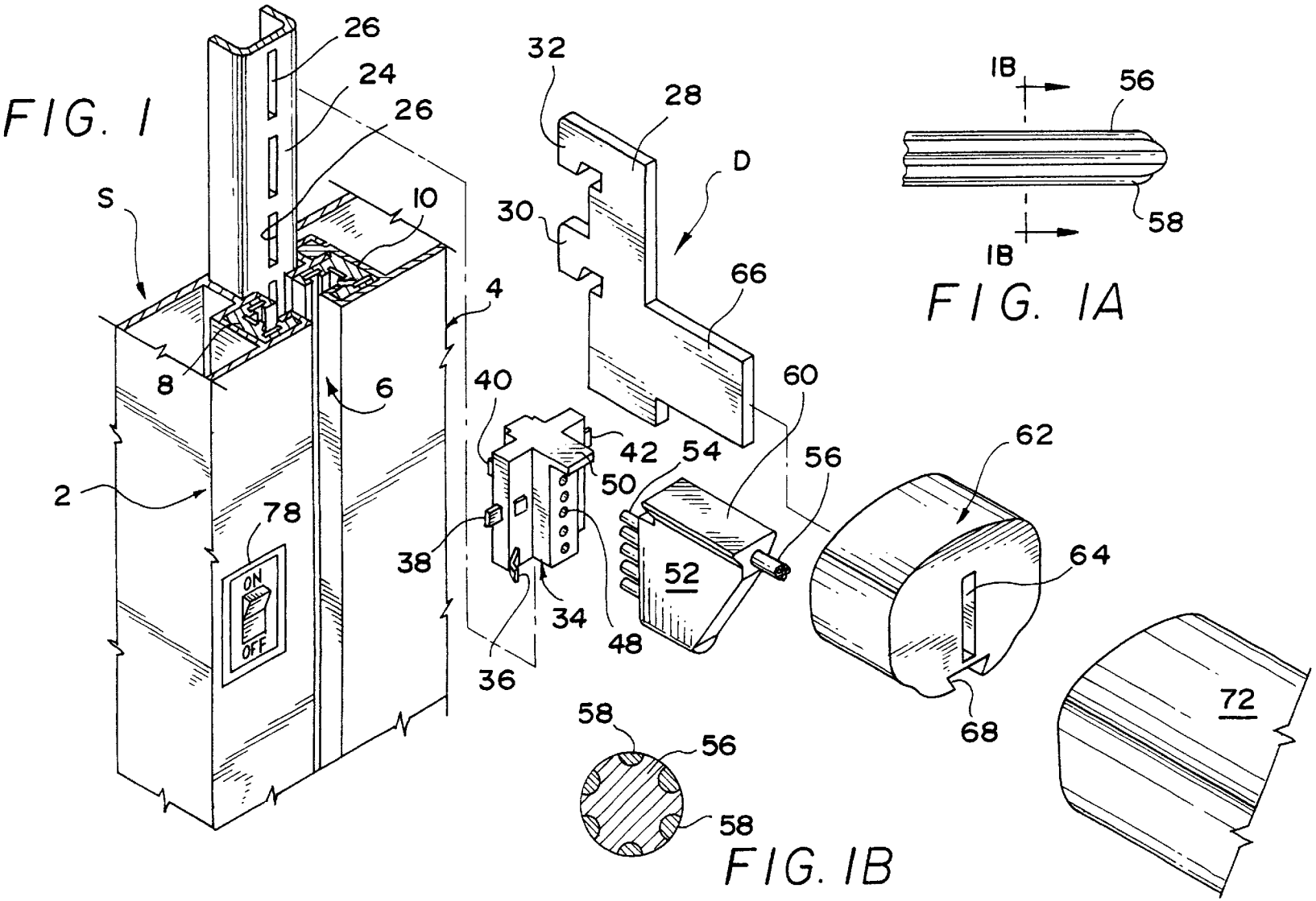
FIG. 1 is an exploded view of the assembly a portion of which is shown as a fragment with cross-sectional detail.
FIG. 1A is an enlarged fragmentary side elevation view of a connector as used in a plug of FIG. 1.
FIG. 1B is a cross-sectional view taken along the lines 1B in FIG. 1A and viewed in the direction of the arrows.

In FIG. 1, the adjustable light display assembly D as shown in the exploded figure, includes a support S which includes interlocking panel members 2 and 4. The panel members 2 and 4 provide a slot 6 which is generally T-shaped. In the arms of the T-shaped slot 6, are positioned electrical circuit conducting means 8 and 10. The electrical circuit conducting means 8 and 10 are generally shown as U-shaped members which run the length of the slot 6. Instead of the U-shaped members 8 and 10, electrical tapes can be fixed to the walls of the T-shaped slot 6 as well as other electrical circuit conducting means such as wires or the like. The electrical circuit conducting means 8 and 10 carry a plurality of circuit contacts 12, 14, 16, 18, 20 and 22.

Figure 2:
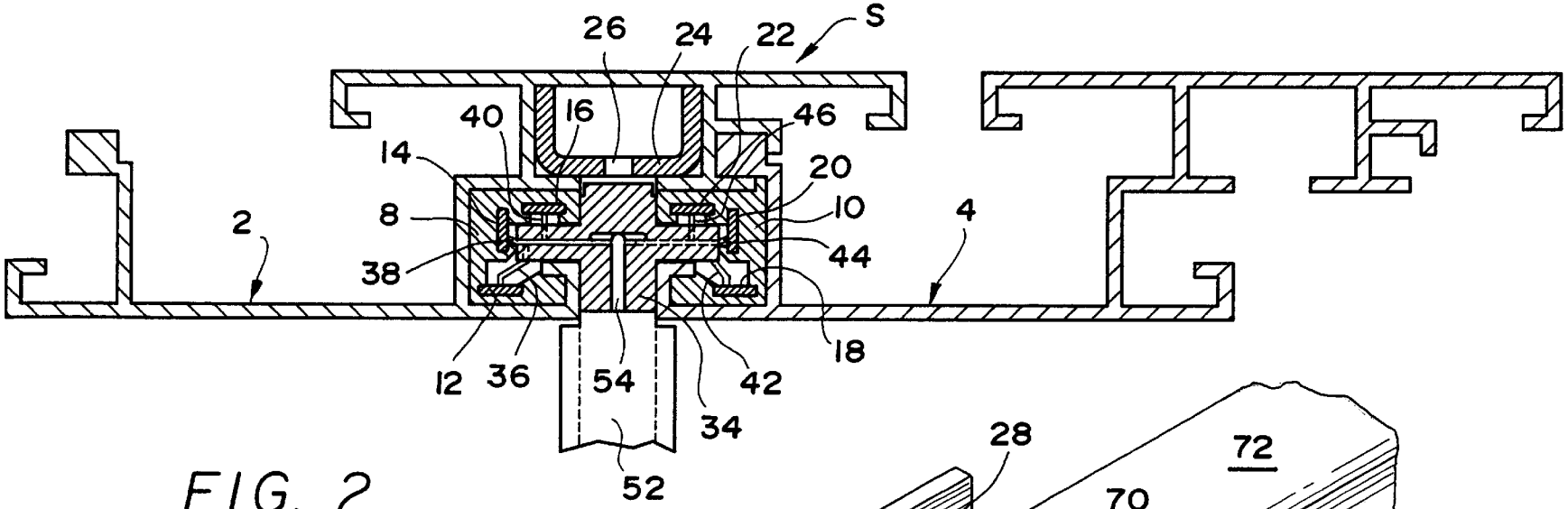
FIG. 2 is a fragmentary cross-sectional view showing the panel mount of the adjustable light display assembly.
Figure 3:
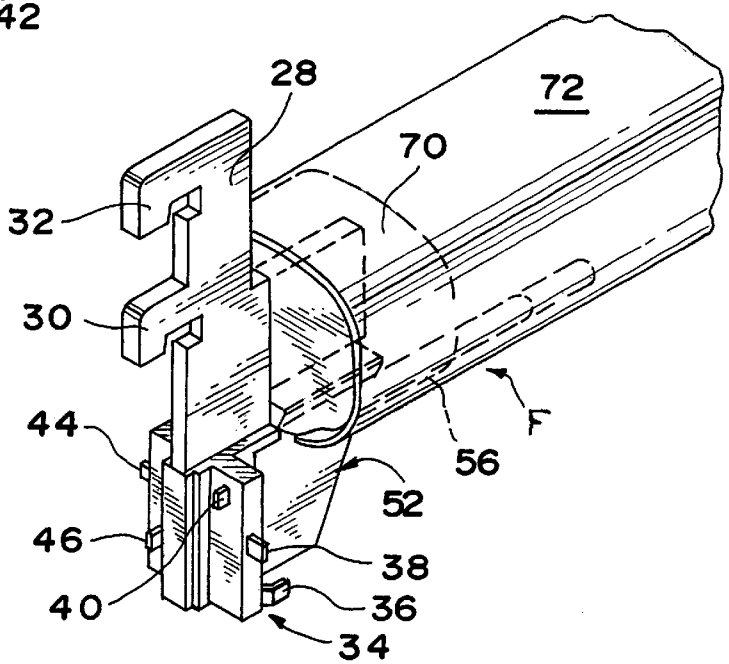
FIG. 3 is a fragmentary perspective view of the assembly unit away from the panel mount of FIG. 2, portions of which are shown in phantom lines.
Figure 4:
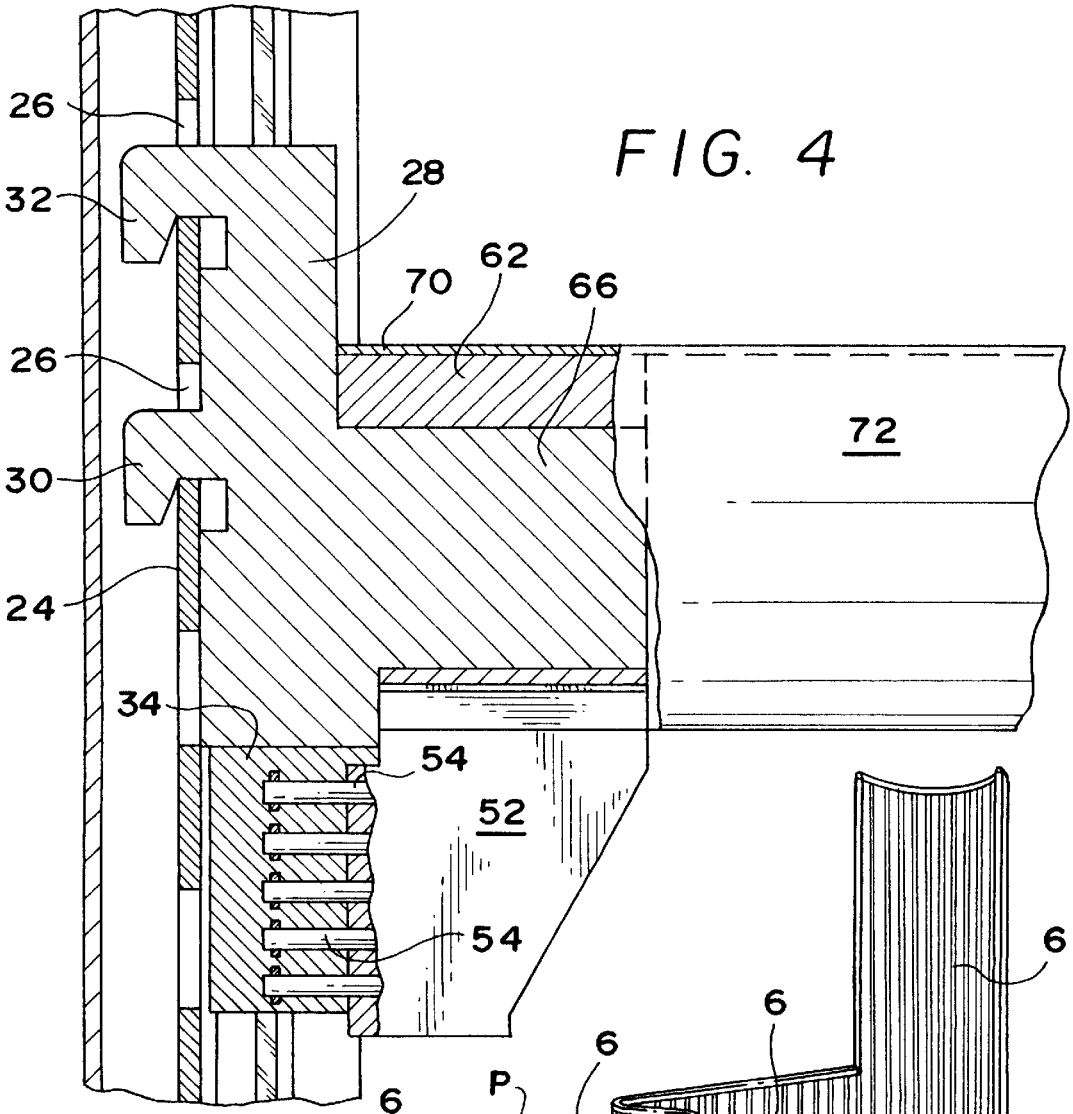
FIG. 4 is a is fragmentary cross-sectional view showing the assembly mounted in a panel.

As shown in FIGS. 1 and 2, a back-up bar 24 is provided having bracket slots 26. The back-up bar 24 with the bracket slots 26 positions the bracket 28 by means of lugs 30 and 32. The lugs 30 and 32 of the bracket 28 lock the adjustable light display unit F in the back-up bar 24. The bracket slots 26 are sufficiently long to provide clearance for the lugs 30 and 32 to be inserted therein and locked downwardly to prevent accidental removal of the adjustable light display unit F from the back-up bar 24. It is obvious that other arrangements can be made in the back of the slot 6 to adjustably receive the bracket 28 including extension of the panel members 2 or 4.

Mounted in the slot 6 is a slidable electrical receptacle 34 having contact members 36, 38, 40, 42, 44 and 46 engaging the circuit contacts 12, 14, 16, 18, 20 and 22. Although a number of circuit contacts 12, 14, 16, 18, 20 and 22 are shown, more or less can be provided as needed depending upon the lighting system. The slideable electrical receptacle 34 may be inserted at the top of the slot 6 (see cap 78 FIG. 8 which is removable).

The electrical receptacle 34 is generally T-shaped in configuration and includes plugs insert holes 48. Above the insert holes 48 is a lever 50 which permits the electrical receptacle 34 to be moved manually up and down in the slot 6.

A plug 52 is provided with prongs 54 which engage the plug insert holes 48. The number of prongs 54 in the plug 52 will depend upon the number of circuits utilized and carried by the electrical receptacle 34. At the rear of the plug 52 is an electrical connector 56 carrying a series of contacts 58 as best seen in FIGS. 1A and 1B. The plug 52 at the top thereof includes a dovetail 60. Wire leads or clips may be used in place of connector 56.

A light receptacle support body 62 includes a slot 64 which receives the arm 66 of the bracket 28. The dovetail slot 68 receives the dovetail 60 of the plug 52.

The light receptacle support body 62 receives the sleeve portion 70 of the light 72. The electrical connector 56 on the plug 52 connects with the electrical circuitry(not shown) of the light 72.

Figure 5:
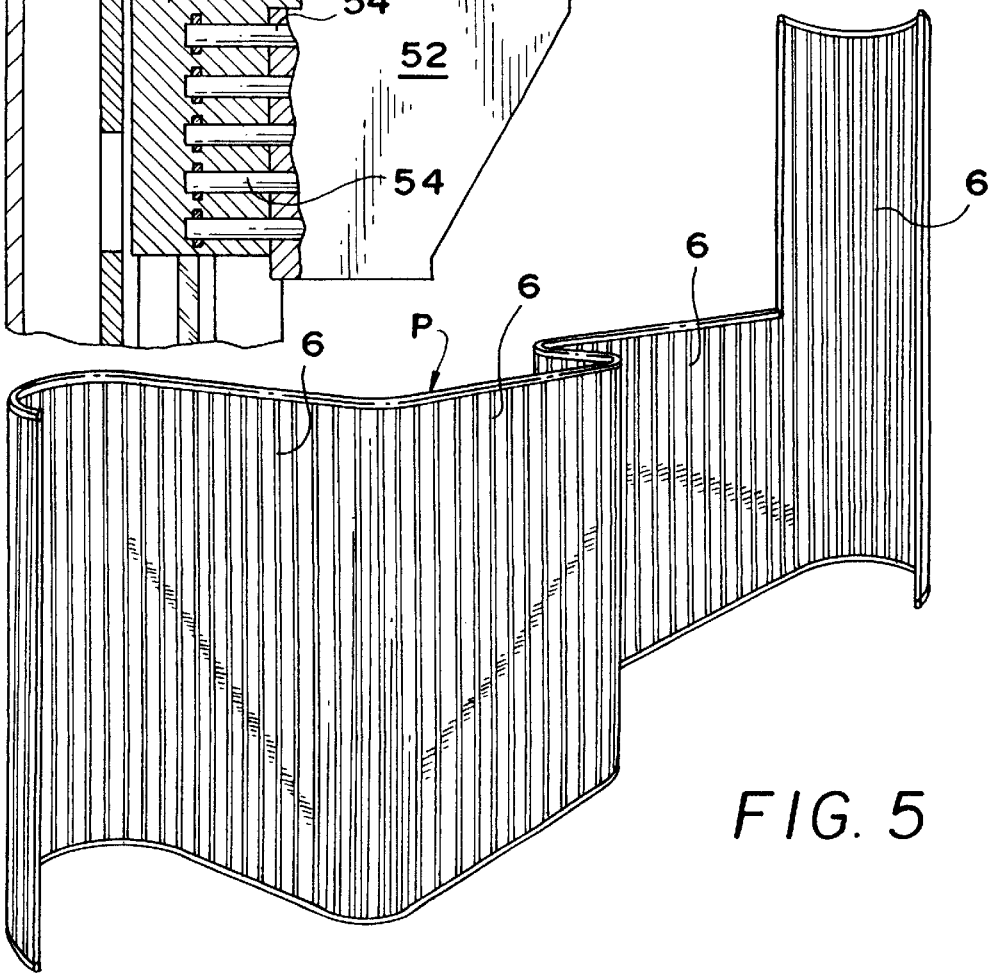
FIG. 5 is a panel showing various straight and curvilinear designs for panel mountings of the adjustable light display assembly.

FIG. 5 shows a panel P with slots 6 for mounting various adjustable light display units F. It is to be noted that the panel can have straight or curved walls.

Figure 6:
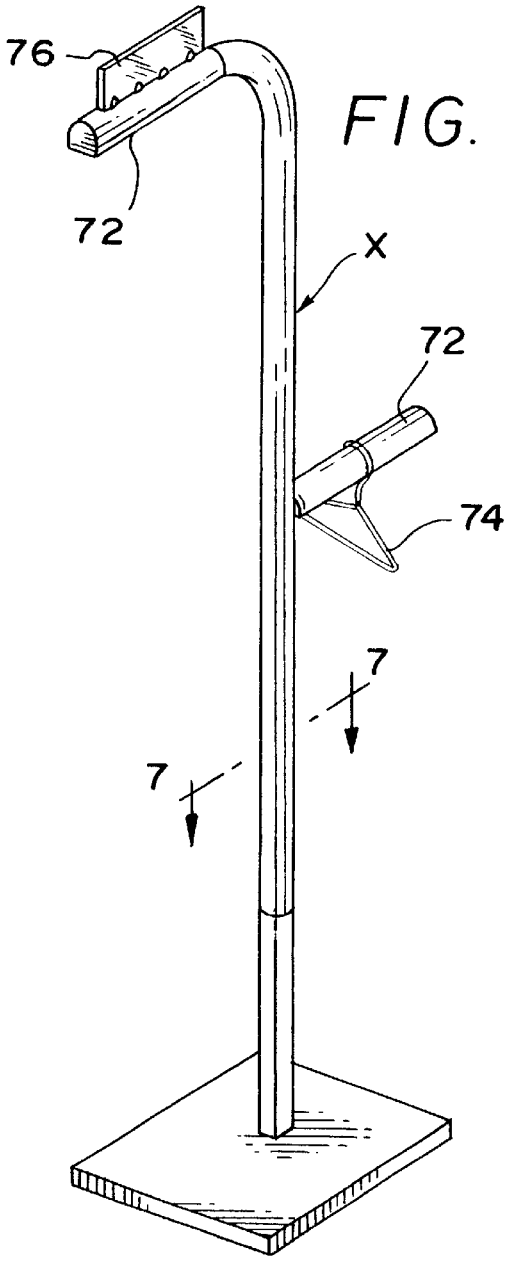
FIG. 6 is a free standing vertical stand showing the light adaptable for advertising as well as for support of hanger support.

FIG. 6 shows a free standing display pole X with lights 72 which may carry hangers 74 or a display sign 76.

Figure 7:
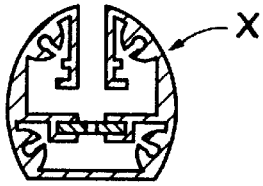
FIG. 7 is a cross-sectional view taken along the lines 7—7 of FIG. 6 and viewed in the direction of the arrows.

FIG. 7 shows in general a cross-section of the pole prior to insertion of adjustable light display unit F.

Figure 8:
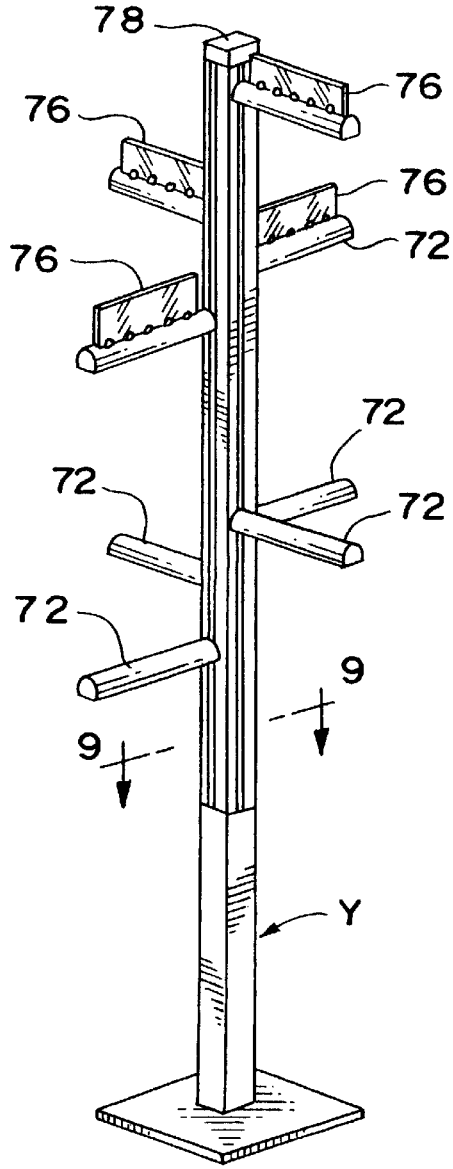
FIG. 8 is a free standing stand showing multiple tracks for positioning lights in various directions and including advertising means.
Figure 9:
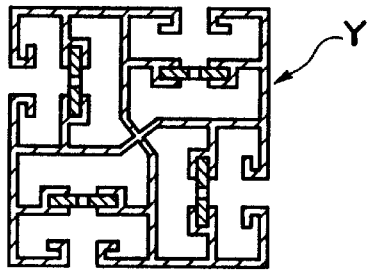
FIG. 9 is a cross-sectional view taken along the lines 9—9 of FIG. 8 and viewed in the direction of the arrows.

FIG. 8 shows a display pole Y which has multiple circuits for supporting hangers 74 or signs 76. FIG. 9 shows a cross-section of the display pole.

An on/off switch 78 can be provided for the adjustable light display assembly D as illustrated in FIG. 1. Means for supplying electricity to the adjustable light display assemblies D (not shown) would be of standard type and could include a ballast (not shown).

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An adjustable light assembly comprising:

a) a support having length and width;

b) said support having a slot extending along the length of said support;

c) said slot having a rear and side walls;

d) said rear wall having a series of spaced receivers;

e) a bracket;

f) said bracket having at least one lug adjustably mounted in a selected one of said series of said receivers and extending outwardly from said slot;

g) said bracket having a support arm;

h) said slot having electrical circuit conducting means extending the length of at least one wall of said slot;

i) an electrical receptacle slidably mounted in said slot and having electrical contact means engaging said electrical circuit conducting means of said slot and having electrical plug receiving means extending outwardly of said slot;

j) an electrical plug engageable with said electrical receptacle;

k) said bracket support arm extending outwardly from said slot;

l) said electrical plug having an electrical connector;

m) a light receptacle support body for receiving said bracket support arm and said electrical plug;

n) a light;

o) said light receptacle support body supporting said light; and p) said electrical connector electrically connecting said plug with said light.

2. An adjustable light display assembly as in claim 1 and wherein:

a) said slot is T-shaped in cross-section.

3. An adjustable light display assembly as in claim 2 and wherein:

a) said electrical receptacle conforms to said T-shaped slot.

4. An adjustable light display assembly as in claim 1 and wherein:

a) said slot includes a plurality of said electrical circuit conducting means; and b) said electrical receptacle and said electrical plug each include a plurality of cooperating electrical contacts cooperating with said plurality of said electrical circuit conducting means.

5. An adjustable light display assembly as in claim 4 and wherein:

a) said plurality electrical circuit conducting means extend the length of more than one wall of said slot.

6. An adjustable light display assembly as in claim 1 and wherein:

a) said bracket includes a plurality of said lugs.

7. An adjustable light display assembly as in claim 1 and wherein:

a) said electrical receptacle includes a lever extending outwardly of said slot for permitting adjustment of said electrical receptacle in said slot.

8. An adjustable light display assembly as in claim 1 and wherein:

a) said light receptacle support body includes a slot for receiving said bracket support arm.

9. An adjustable light display assembly as in claim 1 and wherein:

a) said light receptacle support body includes a dovetail slot;

b) said electrical plug includes a dovetail; and c) said dovetail of said electrical plug is mounted in said dovetail slot of said light receptacle support body.

10. An adjustable light display assembly as in claim 1 and wherein:

a) said support is a vertically supported stand.

11. An adjustable light display assembly as in claim 10 and wherein:

a) said support includes a plurality of said slots.

12. An adjustable light display assembly as in claim 11 and wherein:

a) said support is a multi-paneled wall; and b) each panel of said multi-paneled wall having a plurality of slots.

13. An adjustable light display assembly as in claim 12 and wherein:

a) each of said panels include an interlocking component for interlocking each panel to form a coextensive unit.

14. An adjustable light display assembly as in claim 1 and wherein:

a) said support includes means for inserting said electrical receptacle into said slot for slidably positioning therein.

15. An adjustable light display assembly as in claim 1 and wherein:

a) said spaced receivers are openings in the rear wall of said slots.

16. An adjustable light display assembly as in claim 1 and wherein:

a) said electrical receptacle is mounted below said bracket.

17. An adjustable light display assembly as in claim 1 and wherein:

a) said electrical plug is mounted below said bracket.

18. An adjustable light display assembly as in claim 1 and wherein:

a) said light is a support arm.

19. An adjustable light display unit for use in an electrical track assembly comprising:

a) a bracket for mounting in said electrical track assembly;

b) said bracket having at least one lug for positioning said adjustable light display unit to said electrical track assembly;

c) said bracket having a support arm extending outwardly along a direction away from said electrical track;

d) an electrical receptacle slideable in said electrical track assembly;

e) said electrical receptacle including means for making electrical contact with said electrical track assembly;

f) said electrical receptacle having electrical plug receiving means;

g) an electrical plug removably connected to said electrical plug receiving means;

h) said electrical plug having an electrical connector;

i) a light receptacle support body receiving said bracket support arm and said electrical plug;

j) a light extending longitudinally along the same direction as said support arm;

k) said light receptacle support body supporting said light; and l) said electrical connector electrically connecting said plug with said light.

20. An adjustable light display unit as in claim 19 and wherein:

a) said bracket includes a plurality of lugs.

21. An adjustable light display unit as in claim 19 and wherein:

a) said electrical receptacle includes a lever for ease in adjustment of said adjustable light display unit in an electrical track assembly.

22. An adjustable light display unit as in claim 19 and wherein:

a) said light receptacle support body includes a slot for receiving said bracket support arm.

23. An adjustable light display unit as in claim 19 and wherein:

a) said light receptacle support body include a dovetail slot;

b) said electrical plug includes a dovetail; and c) said dovetail of said electrical plug is mounted in said dovetail slot of said light receptacle support body.

24. An adjustable light display unit as in claim 19 and wherein:

a) said electrical receptacle is mounted below said bracket.

25. An adjustable light display unit as in claim 19 and wherein:

a) said electrical plug is mounted below said bracket.

26. An adjustable light display unit as in claim 19 and wherein:

a) said light is a support arm.

27. An adjustable light display unit as in claim 19 and wherein:

a) said light support arm includes means for displaying a sign.

28. An adjustable light display assembly as in claim 1 and wherein:

a) said light support arm includes means for displaying a sign.

29. An adjustable light display assembly as in claim 1, and further comprising:

a) an on/off switch associated with said adjustable light display assembly connected to said electrical circuit conducting means to cause a current to flow through said electrical receptacle to said plug and said electrical connector and to said light to turn on said light when said switch is on and to turn off said light when said switch is off.

30. An adjustable light display assembly as in claim 1, wherein:

a) said support arm extends along a direction; and b) said light extends longitudinally along the same direction as said bracket support.

* * * * *